US009779618B2

(12) United States Patent
Ono et al.

(10) Patent No.: US 9,779,618 B2
(45) Date of Patent: Oct. 3, 2017

(54) GARAGE OPENER COMMUNICATING DEVICE-EQUIPPED MOTORCYCLE

(75) Inventors: Kazuhiko Ono, Saitama (JP); Koji Suzuki, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1232 days.

(21) Appl. No.: 12/461,756

(22) Filed: Aug. 24, 2009

(65) Prior Publication Data

US 2010/0079305 A1 Apr. 1, 2010

(30) Foreign Application Priority Data

Sep. 29, 2008 (JP) ..... 2008-250027

(51) Int. Cl.
*G08C 17/02* (2006.01)

(52) U.S. Cl.
CPC ..... *G08C 17/02* (2013.01)

(58) Field of Classification Search
CPC ..... B60R 1/12; B60R 2001/1215; B60R 2001/1284; B60R 2001/1223; B60R 1/04; G07C 9/00182; G07C 2009/00928
USPC ..... 340/1.1, 5.1, 5.2, 5.7, 5.71
See application file for complete search history.

(56) References Cited

U.S. PATENT DOCUMENTS 4,630,160 A * 12/1986 Murayama ..... B60R 11/02 296/37.1
6,147,597 A * 11/2000 Facory ..... 340/425.5
6,372,304 B1 * 4/2002 Sano ..... C23C 16/325 427/249.15
6,566,998 B1 * 5/2003 Facory ..... 340/425.5
6,707,377 B2 * 3/2004 Piper ..... B62J 99/00 340/427
6,879,122 B1 * 4/2005 Stewart ..... E05F 15/668 318/280
6,937,149 B2 * 8/2005 McMahon ..... 340/539.11

FOREIGN PATENT DOCUMENTS

CA 2223498 6/1999
DE 29817260 U1 2/1999
JP 2007-230264 9/2007
WO 2005/112304 A1 11/2005

* cited by examiner

*Primary Examiner* — James Yang
(74) *Attorney, Agent, or Firm* — Squire Patton Boggs (US) LLP

(57) ABSTRACT

A garage door opening device for a motorcycle is provided that includes a vehicle-side communicating device configured to transmit a door opening or closing signal to a garage-side communicating device. The garage door opening device also includes a manual operation switch configured to initiate sending of the opening or closing signal via the vehicle-side communicating device. The vehicle-side communicating device and the manual operation switch are located separately from each other. The vehicle-side communicating device is disposed inside a front cowl that is forward of a meter housing of the motorcycle.

6 Claims, 4 Drawing Sheets

GARAGE OPENER COMMUNICATING DEVICE-EQUIPPED MOTORCYCLE

BACKGROUND

Field

The present invention relates to vehicle garage door opening devices, and more particularly to a garage door opening device for a motorcycle.

Description of Related Art

An in-vehicle antenna device and garage door opening system is known that may be mounted on the front portion of a roof of an automobile (see, e.g., JP 2007-230264). For motorcycles, while uncommon, a garage door opener transmitter used with a motorcycle may be mounted on a body frame of a motorcycle and a manual operation switch is disposed on a handlebar grip (see, e.g., Canadian Patent No. 2,223,498).

However, in the conventional garage door opener transmitter-equipped motorcycle mentioned above, the manual operation switch is attached via a plastic tie to locations such as under the seat or on the handlebars or steering head. Further, the transmitter and the manual operation switch are connected to one another by physical wires that run on the outside of the motorcycle. Accordingly, the installation and operability of the manual operation switch may be cumbersome.

SUMMARY

In an embodiment, a garage door opening device for a motorcycle includes a vehicle-side communicating device configured to transmit a door opening or closing signal to a garage-side communicating device. The garage door opening device also includes a manual operation switch configured to initiate sending of the opening or closing signal via the vehicle-side communicating device. The vehicle-side communicating device and the manual operation switch are located separately from each other. The vehicle-side communicating device is disposed inside a front cowl that is forward of a meter housing of the motorcycle.

In another embodiment, a method includes transmitting a door opening or closing signal to a garage-side communicating device. The method also includes initiating sending, by a manual operation switch, of the opening or closing signal via a vehicle-side communicating device. The vehicle-side communicating device and the manual operation switch are located separately from each other. The vehicle-side communicating device is disposed inside a front cowl that is forward of a meter housing of a motorcycle.

BRIEF DESCRIPTION OF THE DRAWINGS

In order that the embodiments of the invention will be readily understood, a more particular description of the invention briefly described above will be rendered by reference to specific embodiments that are illustrated in the appended drawings. A garage door opening device-equipped motorcycle according to some embodiments of the present invention is described herein with reference to the drawings. It is to be noted that the drawings shall be viewed based on the direction of reference numerals. In the following description, the front and back or rear, the left and right, and up and down are based on the direction in which a rider would be facing. In the drawings, the front of a vehicle is denoted with "Fr", the rear or back "Rr", the left "L", the right "R", up "U", and down "D". While it should be understood that these drawings illustrate only certain embodiments of the invention and are not therefore to be considered to be limiting of its scope, the invention will be described and explained with additional specificity and detail through the use of the accompanying drawings, in which.

DETAILED DESCRIPTION

According to some embodiments of the present invention, the vehicle-side communicating device and the manual operation switch are located separately from one another. Therefore, the vehicle-side communicating device can be disposed at a position where its communication with a garage door opener in a garage is improved because there is no metal portion of the motorcycle obstructing communication. In addition, the manual operation switch can be disposed at a position where its operability is convenient and effective. Additionally, the vehicle-side communicating device may be disposed inside the front cowl and forward of the meter housing (which could be meters or gauges such as the speedometer) of the motorcycle. Therefore, the vehicle-side communicating device can be disposed at a position where the vehicle-side communicating device is not seen from the outside, thus preventing theft and mischief. In addition, the resistance of the vehicle-side communicating device to environmental conditions can be improved.

According to some embodiments of the present invention, since the vehicle-side communicating device is disposed on the vehicle body centerline, the direction of the communication signal sent by the vehicle-side communicating device is better positioned to target the garage door opener in a garage compared with a vehicle-side communicating device that is disposed on one side of the vehicle. This may improve communication of the vehicle-side communicating device with the garage door opener in the garage.

According to some embodiments of the present invention, the vehicle-side communicating device includes the antenna. This can eliminate the need for additional wiring, attachment parts, and installation space that are required if the antenna is separate from the vehicle-side communicating device. Thus, the vehicle-side communicating device can be made more compact than is possible if the antenna is separate from the vehicle-side communicating device.

According to some embodiments of the present invention, the manual operation switch is disposed in front of the rider and on either the left or the right side of the vehicle. Therefore, the operability of the manual operation switch is convenient without disturbing the rider's operation of the motorcycle.

Figure 1:
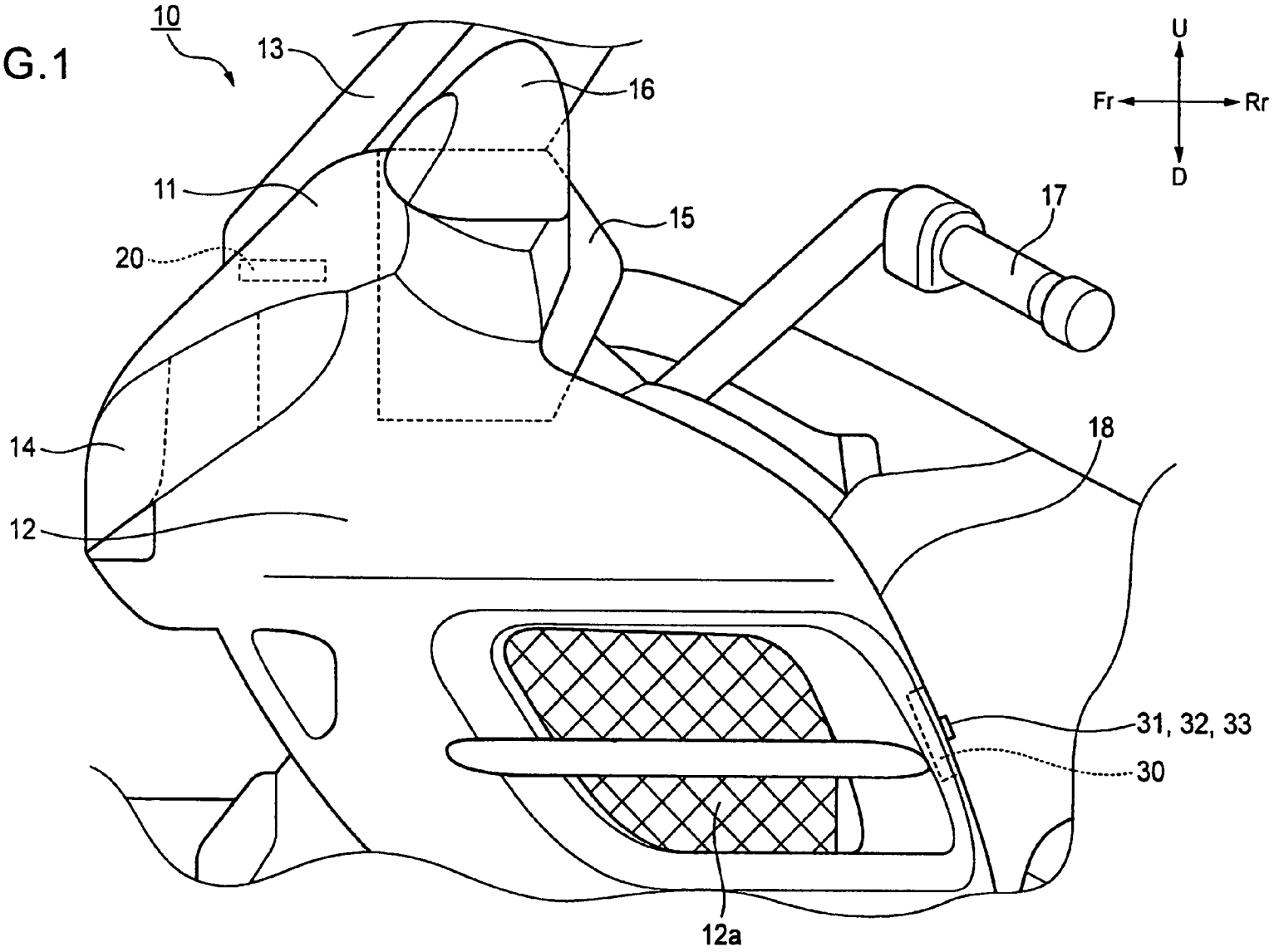
FIG. 1 illustrates an enlarged left lateral view of a motorcycle equipped with a garage door opening device, according to an embodiment of the present invention.
Figure 2:
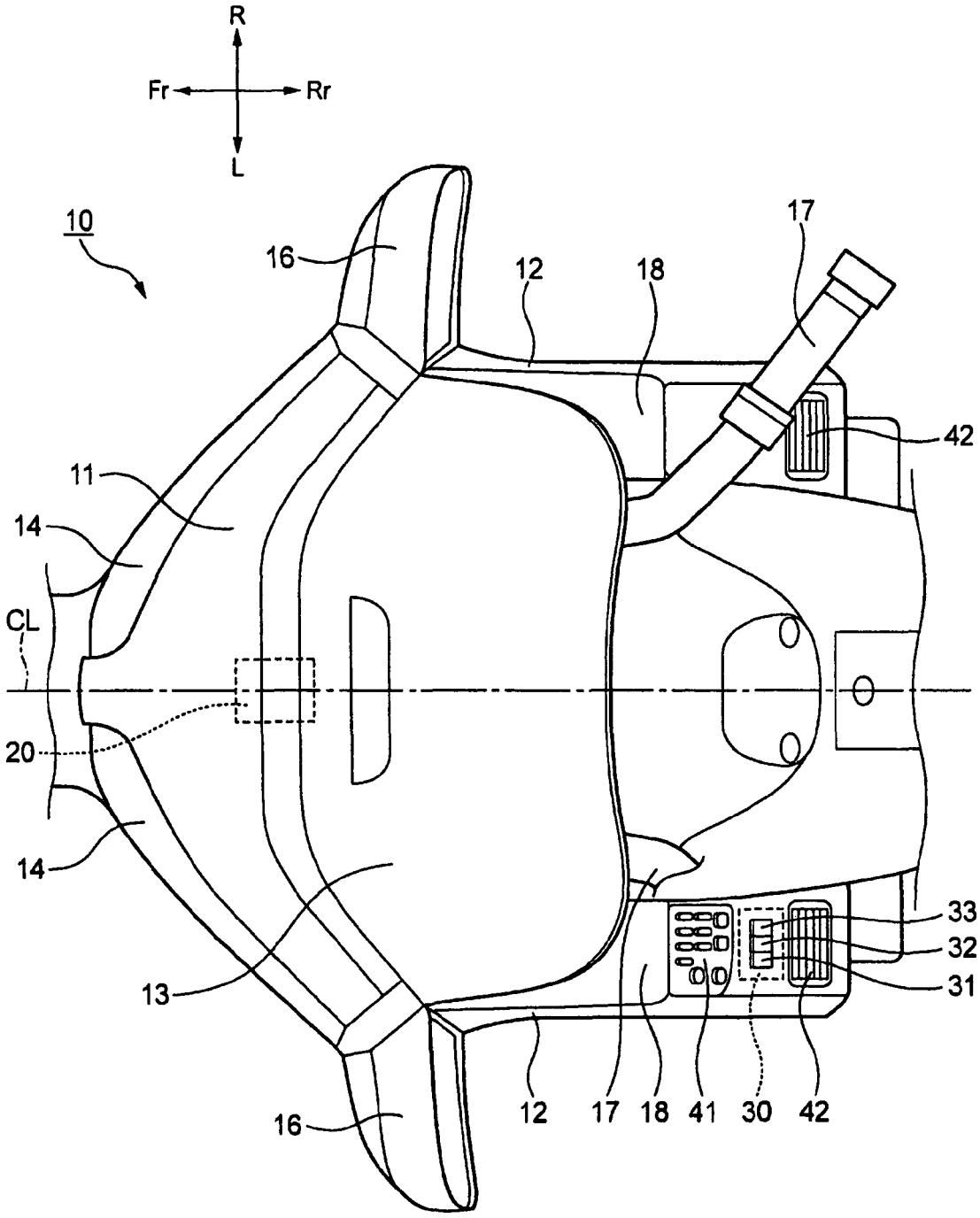
FIG. 2 illustrates an enlarged top view of a motorcycle equipped with a garage door opening device, according to an embodiment of the present invention.

Referring to FIGS. 1 and 2, a motorcycle 10 includes a front cowl 11 covering the front of a body frame (not illustrated), a side cowl 12 covering the sides of the body frame, a windshield 13 attached to the upper portion of the front cowl 11, and a headlight 14 provided at the front end of the front cowl 11 and the side cowl 12. The motorcycle 10 further includes a meter housing 15 provided on the inside of the front cowl 11 and the side cowl 12, rear view mirrors 16 provided on both sides of the front cowl 11, and handlebars 17 used to steer the motorcycle 10. Reference numeral 12*a* in FIG. 1 is an air outlet provided on the lateral surface of the side cowl 12.

Figure 3:
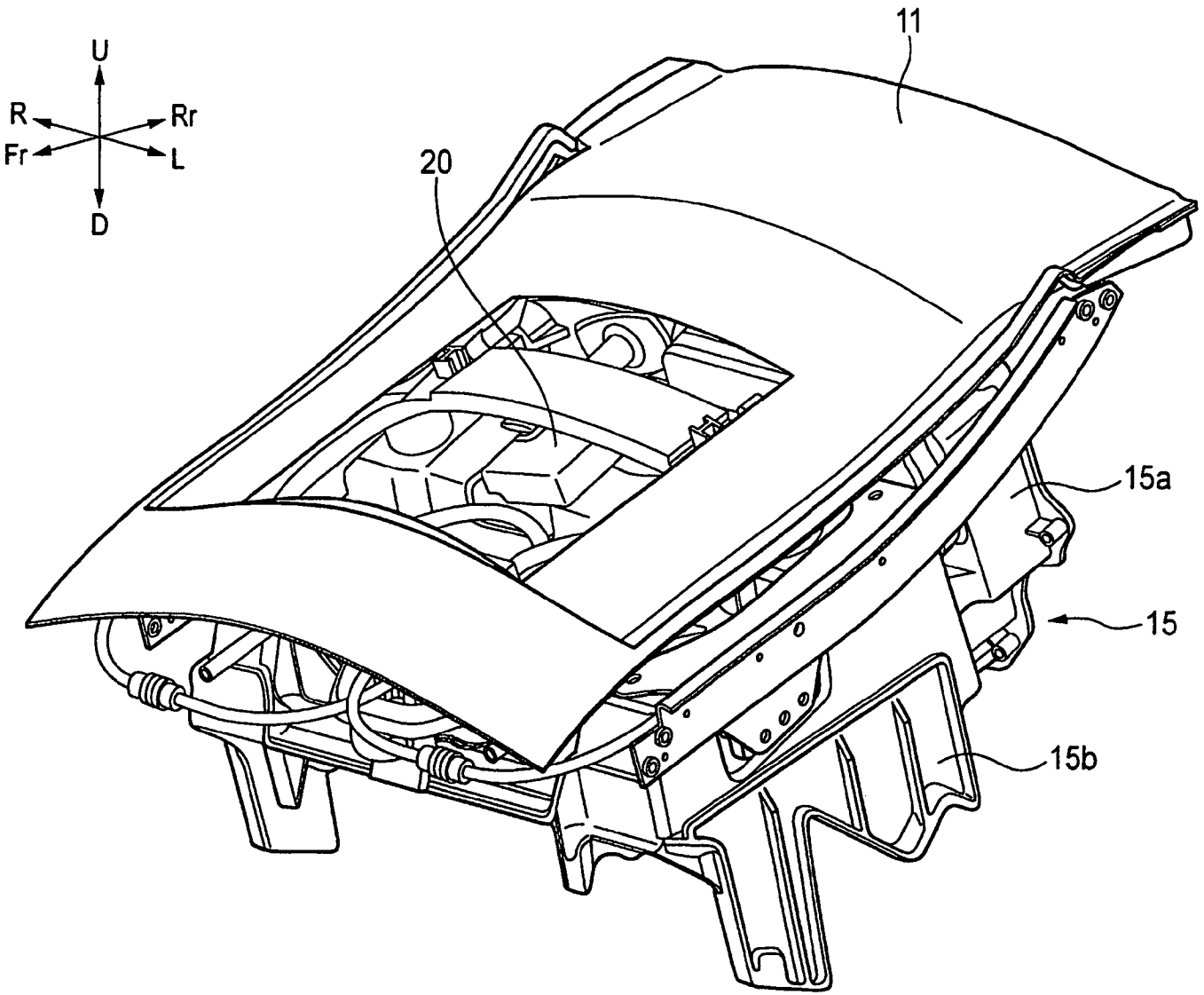
FIG. 3 illustrates a partial cut-away perspective view of a motorcycle equipped with a garage door opening device, according to an embodiment of the present invention.

As illustrated in FIGS. 1 to 3, a vehicle-side communicating device 20 and a manual operation switch 30 are located separately from each other. The vehicle-side communicating device 20 is configured to send a door or shutter opening/closing signal to a garage-side communicating device of a garage door opener (not illustrated) for operating an actuator configured to open/close the door of a garage. The manual operation switch 30 causes the vehicle-side communicating device 20 to send an opening/closing signal to the garage-side communicating device of a garage door opener. The vehicle-side communicating device 20 and the manual operation switch 30 are connected through a communication cable (not illustrated). The vehicle-side communicating device includes an antenna.

As illustrated in FIGS. 1 to 3, the vehicle-side communicating device 20 is disposed inside the front cowl 11 and forward of the meter housing 15. As illustrated in FIG. 3, the meter housing 15 includes gauges 15*a* and a speaker box 15*b* disposed forward of the gauges 15*a*.

As illustrated in FIG. 2, the vehicle-side communicating device 20 is disposed on a vehicle body centerline CL of the motorcycle 10.

Figure 4:
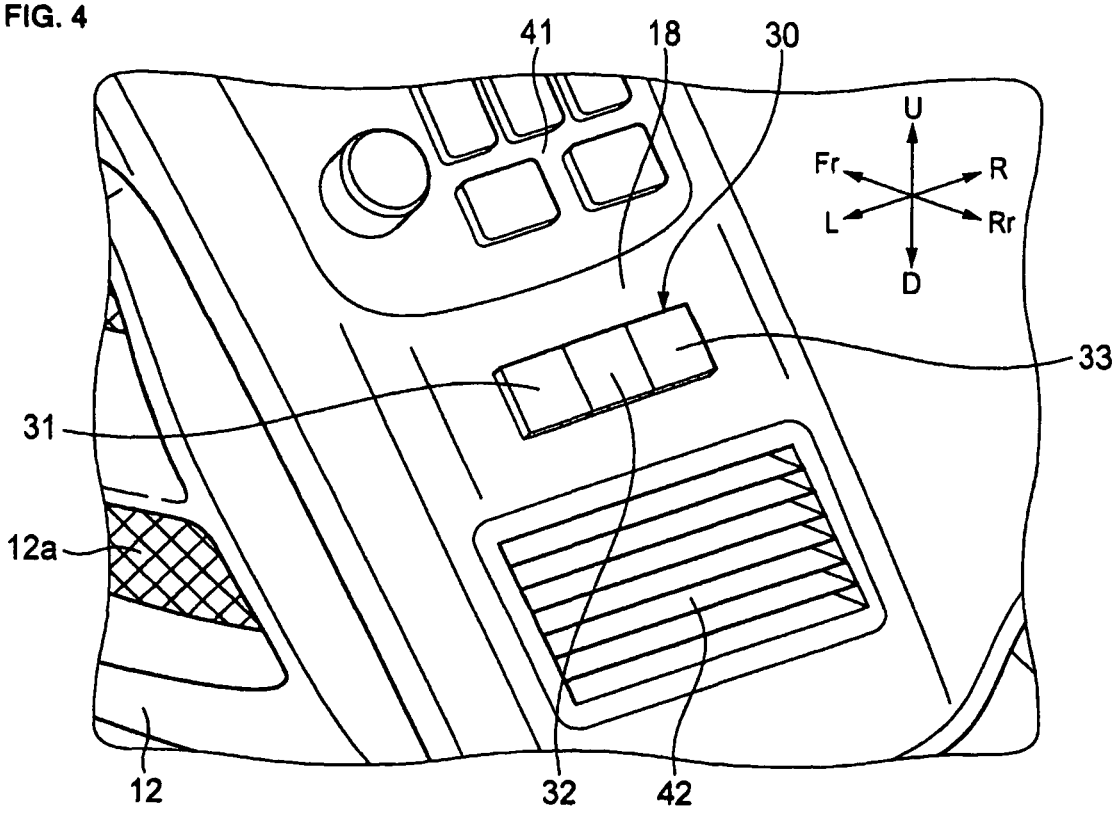
FIG. 4 illustrates a perspective view of a manual operation switch for operating a vehicle-side communicating device for a motorcycle, according to an embodiment of the present invention.

As illustrated in FIGS. 1 and 2, the manual operation switch 30 is disposed before the rider and on an inner panel 18 joined to the inside of the side cowl 12 on the left side of the vehicle. As illustrated in FIG. 4, the manual operation switch 30 includes an opening switch 31, a stop switch 32 and a closing switch 33 in this order starting from the left side of the vehicle. The manual operation switch 30 may be disposed on the inner panel 18 on the right side of the vehicle. However, in some embodiments, it may be preferred that the manual operation switch 30 be disposed on the inner panel 18 on the left side of the vehicle due to operation of the accelerator. Reference numeral 41 in FIG. 4 is a switch panel on which an audio button, a hazard switch, a fog light switch, etc., are arranged. In addition, reference numeral 42 is a side ventilation.

As described above, according to the garage door opening device-equipped motorcycle 10 of some embodiments of the present invention, the vehicle-side communicating device 20 and the manual operation switch 30 are located separately from each other. Accordingly, the vehicle-side communicating device 20 can be disposed at a position where communication with a garage door opener in a garage is not impeded because there is no metal portion of the motorcycle interfering with the communication. In addition, the manual operation switch 30 can be disposed at a position that is convenient to the rider.

DESCRIPTION OF REFERENCE NUMERALS

10: Motorcycle
11: Front cowl
12: Side cowl
13: Windshield
14: Headlight
15: Meter housing
15*a*: Meter
15*b*: Speaker box
16: Rearview mirror
17: Handlebar
18: Inner panel
20: Vehicle-side communicating device
30: Manual operation switch
31: Opening switch
32: Stop switch
33: Closing switch
CL: Vehicle body centerline

We claim:

1. A garage door opening device for a motorcycle, comprising:

a vehicle-side communicating device configured to transmit an opening or closing signal to a garage-side communicating device; and a manual operation switch configured to initiate sending of the opening or closing signal via the vehicle-side communicating device, wherein the manual operation switch is disposed in front of a rider and on an inner panel joined to an inside of a side cowl of the motorcycle, wherein the vehicle-side communicating device and the manual operation switch are located separately from each other, wherein the vehicle-side communicating device is disposed inside a front cowl that is forward and directly in front of a meter housing provided on the inside of the front cowl of the motorcycle where there is no metal portion of the motorcycle obstructing communication, wherein the vehicle-side communicating device is disposed immediately below a top surface of the front cowl, wherein the vehicle-side communicating device is disposed forward and directly in front of gauges of the meter housing and a speaker box of the meter housing, wherein the vehicle-side communicating device is disposed on a vehicle body centerline of the motorcycle, and wherein the vehicle-side communicating device comprises an antenna, and wherein wiring used to connect the vehicle-side communicating device and the manual operation switch is housed inside a vehicle body of the motorcycle.

2. A method for controlling a garage door, comprising:

initiating sending, by a manual operation switch, of an opening or closing signal by a vehicle-side communicating device; and transmitting, by the vehicle-side communicating device, the opening or closing signal to a garage-side communicating device, wherein the vehicle-side communicating device and the manual operation switch are located separately from each other, wherein the vehicle-side communicating device is disposed inside a front cowl that is forward and directly in front of a meter housing provided on the inside of the front cowl of a motorcycle where there is no metal portion of the motorcycle obstructing communication, wherein the vehicle-side communicating device is disposed immediately below a top surface of the front cowl, wherein the vehicle-side communicating device is disposed forward and directly in front of gauges of the meter housing and a speaker box of the meter housing, wherein the transmitting comprises transmitting the opening or closing signal by the vehicle-side communicating device that is disposed on a vehicle body centerline of the motorcycle, wherein the transmitting comprises transmitting the opening or closing signal by the vehicle-side communicating device that comprises an antenna, wherein the initiating sending comprises initiating sending by the manual operation switch that is disposed in front of a rider and on an inner panel joined to an inside of a side cowl of the motorcycle, and wherein the initiating sending comprises initiating sending of the opening or closing signal via wiring connecting the vehicle-side communicating device and the manual operation switch that is housed inside a vehicle body of the motorcycle.

3. An apparatus for controlling a garage door, comprising:

vehicle-side communicating means for transmitting a door opening or closing signal to a garage-side communicating device; and manual operation switch means for initiating sending of the opening or closing signal via the vehicle-side communicating means, wherein the manual operation switch means is disposed in front of a rider and on an inner panel joined to an inside of a side cowl of the motorcycle, the vehicle-side communicating means and the manual operation means are located separately from each other, the vehicle-side communicating means is disposed inside front cowl means that is forward and directly in front of meter housing means provided on the inside of the front cowl on a motorcycle where there is no metal portion of the motorcycle obstructing communication, the vehicle-side communicating means is disposed immediately below a top surface of the front cowl, the vehicle-side communicating means is disposed forward and directly in front of gauges of the meter housing and a speaker box of the meter housing, the vehicle-side communicating means is disposed on a vehicle body centerline of the motorcycle, and wherein the vehicle-side communicating means comprises antenna means, and wiring used to connect the vehicle-side communicating means and the manual operation switch means is housed inside a vehicle body of the motorcycle.

4. The garage door opening device of claim 1, wherein the manual operation switch is configured to initiate sending of a stopping signal to the garage-side communication device via the vehicle-side communicating device.

5. The method of claim 2, wherein the manual operation switch is configured to initiate sending of a stopping signal to the garage-side communication device via the vehicle-side communicating device.

6. The apparatus of claim 3, wherein the manual operation switch means is configured to initiate sending of a stopping signal to the garage-side communication device via the vehicle-side communicating means.

* * * * *